US011946480B2

(12) United States Patent
Yonemura et al.

(10) Patent No.: US 11,946,480 B2
(45) Date of Patent: Apr. 2, 2024

(54) CENTRIFUGAL COMPRESSOR

(71) Applicant: IHI Corporation, Tokyo (JP)

(72) Inventors: Atsushi Yonemura, Tokyo (JP); Ryota Sakisaka, Tokyo (JP); Yudai Kaneko, Tokyo (JP); Takahiro Bamba, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/807,275

(22) Filed: Jun. 16, 2022

(65) Prior Publication Data

US 2022/0307510 A1 Sep. 29, 2022

Related U.S. Application Data

(63) Continuation of application No. PCT/JP2020/048517, filed on Dec. 24, 2020.

(30) Foreign Application Priority Data

Feb. 27, 2020 (JP) ..... 2020-031838

(51) Int. Cl.
*F04D 27/02* (2006.01)
*F04D 29/42* (2006.01)
*F04D 29/46* (2006.01)

(52) U.S. Cl.
CPC ..... *F04D 27/0253* (2013.01); *F04D 29/4206* (2013.01); *F04D 29/462* (2013.01)

(58) Field of Classification Search
CPC ..... F04D 27/0253
See application file for complete search history.

(56) References Cited

U.S. PATENT DOCUMENTS

| | | | | |
|---|---|---|---|---|
| 4,122,668 | A | 10/1978 | Chou et al. | |
| 10,465,706 | B2 * | 11/2019 | Lombard | F02B 37/00 |
| 10,502,232 | B2 | 12/2019 | Mohtar et al. | |
| 2019/0264710 | A1 | 8/2019 | Mohtar et al. | |

FOREIGN PATENT DOCUMENTS

EP 3 530 954 A1 8/2019

OTHER PUBLICATIONS

International Search Report dated Feb. 9, 2021 in PCT/JP2020/048517, filed on Dec. 24, 2020, 2 pages.

* cited by examiner

*Primary Examiner* — Brian O Peters
(74) *Attorney, Agent, or Firm* — Oblon, McClelland, Maier & Neustadt, L.L.P.

(57) ABSTRACT

A centrifugal compressor includes: a housing including an intake flow path; a compressor impeller arranged in the intake flow path; a movable portion arranged upstream of the compressor impeller in a flow of an intake air; and a groove formed in an area other than a surface located on a downstream side in the flow of the intake air in the movable portion.

7 Claims, 10 Drawing Sheets

CENTRIFUGAL COMPRESSOR

CROSS REFERENCE TO RELATED APPLICATIONS

This application is a continuation application of International Application No. PCT/JP2020/048517, filed on Dec. 24, 2020, which claims priority to Japanese Patent Application No. 2020-031838 filed on Feb. 27, 2020, the entire contents of which are incorporated herein by reference.

BACKGROUND ART

Technical Field

The present disclosure relates to a centrifugal compressor.

A centrifugal compressor comprises a compressor housing in which an intake flow path is formed. A compressor impeller is arranged in the intake flow path. When a flow rate of air flowing into the compressor impeller decreases, the air compressed by the compressor impeller flows backward in the intake flow path, causing a phenomenon known as surging.

Patent Literature 1 discloses a centrifugal compressor comprising a throttling mechanism in a compressor housing. The throttling mechanism is located upstream of the compressor impeller in a flow of the intake air. The throttling mechanism comprises a movable portion. The movable portion is configured to move between a protruding position in which the portion protrudes into the intake flow path, and a retracted position in which the portion is retracted from the intake flow path. The throttling mechanism reduces the cross-sectional area of the intake flow path by causing the movable portion to protrude into the intake flow path. When the movable portion protrudes into the intake flow path, the air flowing backward in the intake flow path is blocked by the movable portion. Surging is curbed by blocking the air flowing backward in the intake flow path.

CITATION LIST

Patent Literature

Patent Literature 1: EP 3530954 A1

SUMMARY

Technical Problem

In the movable portion of Patent Literature 1, a groove is formed on a surface opposite the compressor impeller in an area protruding into the intake flow path. The air flowing backward in the intake flow path flows into this groove when surging occurs. When the air flowing backward flows into the groove, a pressure loss is caused, which leads to a decrease in compressor efficiency.

The present disclosure aims to provide a centrifugal compressor that can curb a decrease in compressor efficiency.

Solution to Problem

In order to address the above-described problem, a centrifugal compressor according to an aspect of the present disclosure includes: a housing including an intake flow path; a compressor impeller arranged in the intake flow path; a movable portion arranged upstream of the compressor impeller in a flow of an intake air; and a groove formed in an area other than a surface located on a downstream side in the flow of the intake air in the movable portion.

The groove may be formed on a surface located on an upstream side in the flow of the intake air in the movable portion.

The groove may be formed on a radial outer surface of the movable portion.

The groove may extend in a circumferential direction of the compressor impeller.

Effects of Disclosure

According to the present disclosure, the decrease in compressor efficiency can be curbed.

DESCRIPTION OF EMBODIMENTS

Embodiments of the present disclosure will be described in detail below with reference to the accompanying drawings. Specific dimensions, materials, and numerical values described in the embodiments are merely examples for a better understanding, and do not limit the present disclosure unless otherwise specified. In this specification and the drawings, duplicate explanations are omitted for elements having substantially the same functions and configurations by assigning the same sign. Furthermore, elements not directly related to the present disclosure are omitted from the figures.

Figure 1:
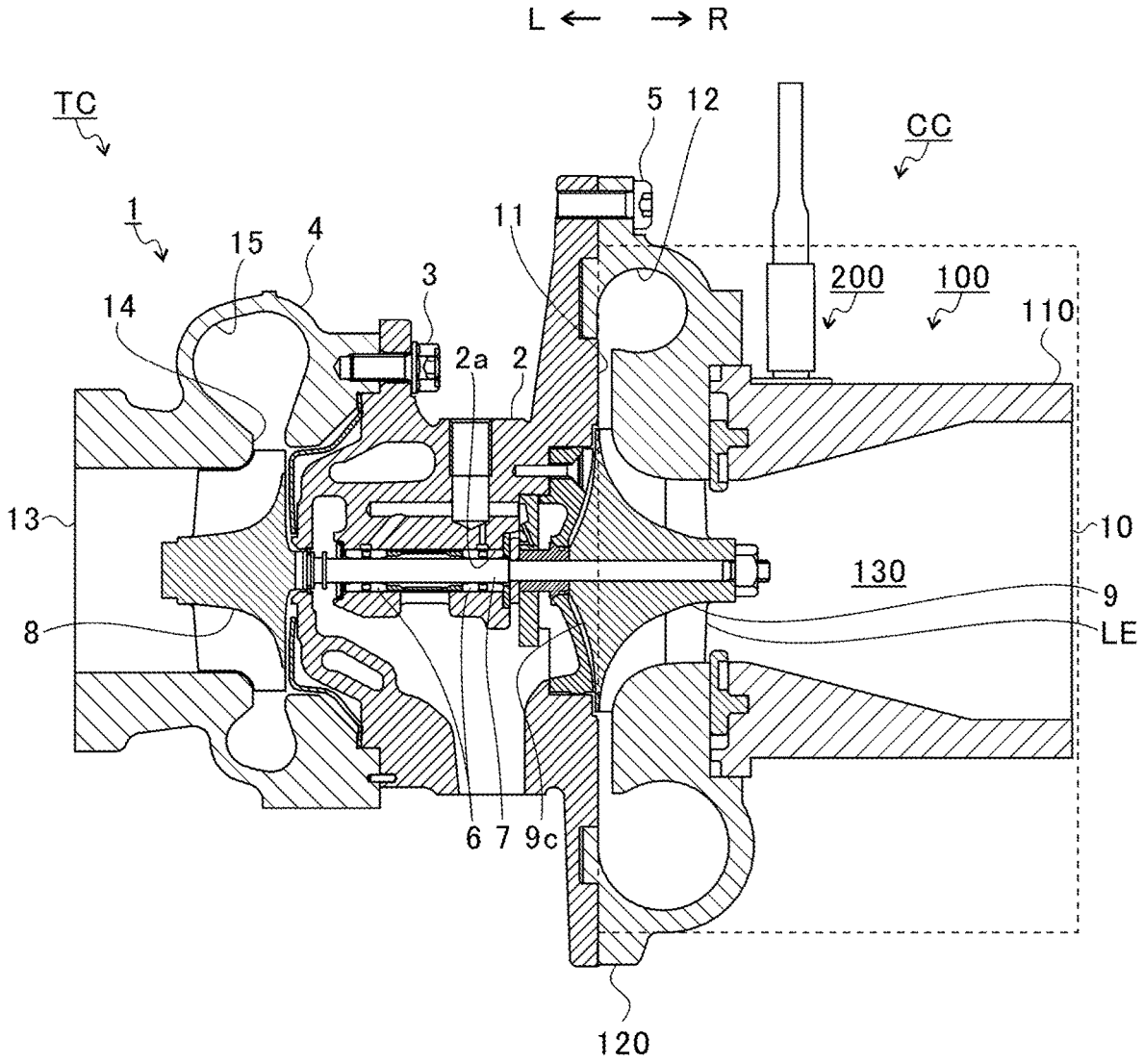
FIG. 1 is a schematic cross-sectional view of a turbocharger.

FIG. 1 is a schematic cross-sectional view of a turbocharger TC. A direction indicated by an arrow L in FIG. 1 is explained as a left side of the turbocharger TC. A direction indicated by an arrow R in FIG. 1 is explained as a right side of the turbocharger TC. A part including a compressor housing 100 (described later) in the turbocharger TC functions as a centrifugal compressor CC. Hereinafter, the centrifugal compressor CC is explained as being driven by a turbine impeller 8 (described later). However, the centrifugal compressor CC is not limited thereto, and may be driven by an undescribed engine or by an undescribed electric motor. As such, the centrifugal compressor CC may be incorporated into a device other than the turbocharger TC, or may be a stand-alone device.

As shown in FIG. 1, the turbocharger TC comprises a turbocharger body 1. The turbocharger body 1 includes a bearing housing 2, a turbine housing 4, a compressor housing (housing) 100, and a link mechanism 200. Details of the link mechanism 200 will be described later. The turbine housing 4 is connected to the left side of the bearing housing 2 by a fastening bolt 3. The compressor housing 100 is connected to the right side of the bearing housing 2 by a fastening bolt 5.

An accommodation hole 2*a* is formed in the bearing housing 2. The accommodation hole 2*a* penetrates the bearing housing 2 in the left-to-right direction of the turbocharger TC. A bearing 6 is arranged in the accommodation hole 2*a*. In FIG. 1, a full floating bearing is shown as an example of the bearing 6. However, the bearing 6 may be any other radial bearing, such as a semi-floating bearing or a rolling bearing. A part of a shaft 7 is arranged in the accommodation hole 2*a*. The shaft 7 is rotatably supported by the bearing 6. A turbine impeller 8 is provided at the left end of the shaft 7. The turbine impeller 8 is rotatably accommodated in the turbine housing 4. A compressor impeller 9 is provided at the right end of the shaft 7. The compressor impeller 9 is rotatably accommodated in the compressor housing 100.

An inlet 10 is formed in the compressor housing 100. The inlet 10 opens to the right side of the turbocharger TC. The inlet 10 is connected to an air cleaner (not shown). A diffuser flow path 11 is formed between the bearing housing 2 and the compressor housing 100. The diffuser flow path 11 pressurizes air. The diffuser flow path 11 is formed in an annular shape from an inner side to an outer side in a radial direction of the shaft 7 (compressor impeller 9) (hereinafter simply referred to as the radial direction). The diffuser flow path 11 is connected to the inlet 10 via the compressor impeller 9 at a radially inner part.

A compressor scroll flow path 12 is formed in the compressor housing 100. The compressor scroll flow path 12 is formed in an annular shape. For example, the compressor scroll flow path 12 is located radially outside the compressor impeller 9. The compressor scroll flow path 12 is connected to an engine intake (not shown) and to the diffuser flow path 11. When the compressor impeller 9 rotates, air is sucked into the compressor housing 100 from the inlet 10. The intake air is pressurized and accelerated while passing through blades of the compressor impeller 9. The pressurized and accelerated air is pressurized in the diffuser flow path 11 and the compressor scroll flow path 12. The pressurized air flows out of a discharge port (not shown), and is directed to the engine intake.

As such, the turbocharger TC comprises the centrifugal compressor CC. The centrifugal compressor CC includes the compressor housing 100, the compressor impeller 9, and the link mechanism 200 (described later).

An outlet 13 is formed in the turbine housing 4. The outlet 13 opens to the left side of the turbocharger TC. The outlet 13 is connected to an exhaust gas purifier (not shown). A connecting flow path 14 and a turbine scroll flow path 15 are formed in the turbine housing 4. The turbine scroll flow path 15 is located radially outside the turbine impeller 8. The connecting flow path 14 is located between the turbine impeller 8 and the turbine scroll flow path 15.

The turbine scroll flow path 15 is connected to a gas inlet (not shown). Exhaust gas discharged from an engine exhaust manifold (not shown) is directed to the gas inlet. The connecting flow path 14 connects the turbine scroll flow path 15 to the outlet 13. The exhaust gas directed from the gas inlet to the turbine scroll flow path 15 passes through the connecting flow path 14 and blades of the turbine impeller 8 to the outlet 13. The exhaust gas rotates the turbine impeller 8 while passing therethrough.

The rotational force of the turbine impeller 8 is transmitted to the compressor impeller 9 via the shaft 7. As described above, the air is pressurized by the rotational force of the compressor impeller 9 and directed to the engine intake.

Figure 2:
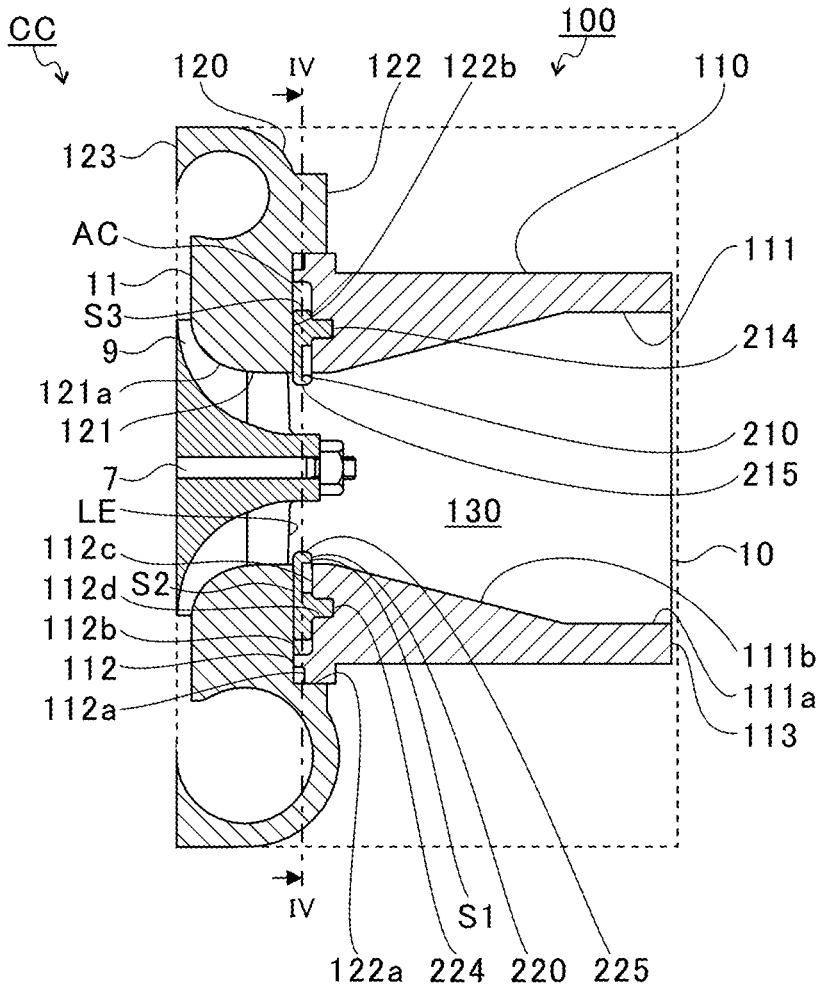
FIG. 2 is an extract of an area enclosed by dashed lines in FIG. 1.

FIG. 2 is an extract of an area enclosed by dashed lines in FIG. 1. As shown in FIG. 2, the compressor housing 100 includes a first housing portion 110 and a second housing portion 120. The first housing portion 110 is located on a right side to the second housing portion 120 in FIG. 2 (a side spaced apart from the bearing housing 2). The second housing portion 120 is connected to the bearing housing 2. The first housing portion 110 is connected to the second housing portion 120.

The first housing portion 110 has a substantially cylindrical shape. A through hole 111 is formed in the first housing portion 110. The first housing portion 110 includes an end face 112 on a side closer (connected) to the second housing portion 120. Furthermore, the first housing portion 110 includes an end face 113 on a side spaced apart from the second housing portion 120. The inlet 10 is formed on the end face 113. The through hole 111 extends along a rotational axis direction of the shaft 7 (compressor impeller 9) (hereinafter simply referred to as the rotational axis direction) from the end face 112 to the end face 113 (inlet 10). In other words, the through hole 111 penetrates the housing portion 110 in the rotational axis direction. The through hole 111 includes the inlet 10 at the end face 113.

The through hole 111 includes a parallel section 111*a* and a tapered section 111*b*. The parallel section 111*a* is located closer to the end face 113 with respect to the tapered section 111*b*. An inner diameter of the parallel section 111*a* is substantially constant over the rotational axis direction. The tapered section 111*b* is located closer to the end face 112 with respect to the parallel section 111*a*. The tapered section 111*b* is continuous with the parallel portion 111*a*. An inner diameter of the tapered section 111*b* at the position continuous with the parallel portion 111*a* is substantially equal to the inner diameter of parallel section 111*a*. The inner diameter of the tapered section 111*b* decreases as being spaced apart from the parallel section 111*a* (as approaching to the end face 112).

A notch 112*a* is formed on the end face 112. The notch 112*a* is recessed from the end face 112 toward the end face 113. The notch 112*a* is formed at an outer periphery of the end face 112. The notch 112*a* has, for example, a substantially annular shape when seen from the rotational axis direction.

Furthermore, an accommodation chamber AC is formed on the end face 112. In the first housing portion 110, the accommodation chamber AC is formed at a position closer to the inlet 10 with respect to a leading edge of blades of the compressor impeller 9. The accommodation chamber AC includes an accommodation groove 112*b*, a bearing hole 112*d* and an accommodation hole 115 which will be described later.

The accommodation groove 112*b* is formed on the end face 112. The accommodation groove 112*b* is located between the notch 112*a* and the through hole 111. The accommodation groove 112*b* is recessed from the end face 112 toward the end face 113. The accommodation groove 112*b* has, for example, a substantially annular shape when seen from the rotational axis direction. The accommodation groove 112*b* is connected to the through hole 111 at a radially inner part.

The bearing holes 112*d* are formed on a wall surface 112*c* (accommodation chamber opposed surface) on an end face 113 side in the accommodation groove 112*b*. The bearing holes 112*d* extend from the wall surface 112*c* toward the end face 113 in the rotational axis direction. Two bearing holes 112*d* are spaced apart from each other in the rotational direction of the shaft 7 (compressor impeller 9) (hereinafter simply referred to as the rotational direction or circumferential direction). The two bearing holes 112*d* are arranged at positions spaced apart from each other by 180 degrees in the rotational direction.

A through hole 121 is formed in the second housing portion 120. The second housing portion 120 includes an end face 122 on a side proximate (connected) to the first housing portion 110. Furthermore, the second housing portion 120 includes an end face 123 on a side spaced apart from the first housing portion 110 (a side connected to the bearing housing 2). The through hole 121 extends from the end face 122 to the end face 123 along the rotational axis direction. In other words, the through hole 121 penetrates the second housing portion 120 in the rotational axis direction.

An inner diameter of the through hole 121 at an end closer to the end face 122 is substantially equal to the inner diameter of the through hole 111 at the end closer to the end face 112. A shrouded portion 121*a* is formed on an inner wall of the through hole 121. The shroud portion 121*a* faces the compressor impeller 9 from the radially outside. An outer diameter of the compressor impeller 9 increases as being spaced apart from the leading edge LE of the blades of the compressor impeller 9. The inner diameter of the shroud section 121*a* increases as being spaced apart from the end face 122 (as approaching the end face 123).

An accommodation groove 122*a* is formed on the end face 122. The accommodation groove 122*a* is recessed from the end face 122 toward the end face 123. The accommodation groove 122*a* has, for example, a substantially annular shape when seen from the rotational axis direction. The housing portion 110 is inserted into the accommodation groove 122*a*. The end face 112 of the first housing portion 110 is in contact with a wall surface 122*b* on an end face 123 side in the accommodation groove 122*a*. The accommodation chamber AC is formed between the first housing portion 110 (wall 112*c*) and the second housing portion 120 (wall surface 122*b*).

The through hole 111 of the first housing portion 110 and the through hole 121 of the second housing portion 120 defines an intake flow path 130. In other words, the intake flow path 130 is formed in the compressor housing 100. The intake flow path 130 extends from the air cleaner (not shown) to the diffuser flow path 11 via the inlet 10. An air cleaner side (inlet 10 side) of the intake flow path 130 is referred to as an upstream side in a flow of the intake air, and a diffuser flow path 11 side of the intake flow path 130 is referred to as a downstream side in a flow of the intake air.

The compressor impeller 9 is arranged in the intake flow path 130. In a cross-section vertical to the rotational axis direction, the intake flow path 130 (through holes 111, 121) has, for example, a circular shape around the rotational axis of the compressor impeller 9. However, the cross-sectional shape of the intake flow path 130 is not limited thereto, and may be, for example, elliptical.

A sealant (not shown) is arranged in the notch 112*a* of the first housing portion 110. The sealant reduces a flow rate of air passing between the first housing portion 110 and the second housing portion 120. However, the notch 112*a* and the sealant are not essential.

Figure 3:
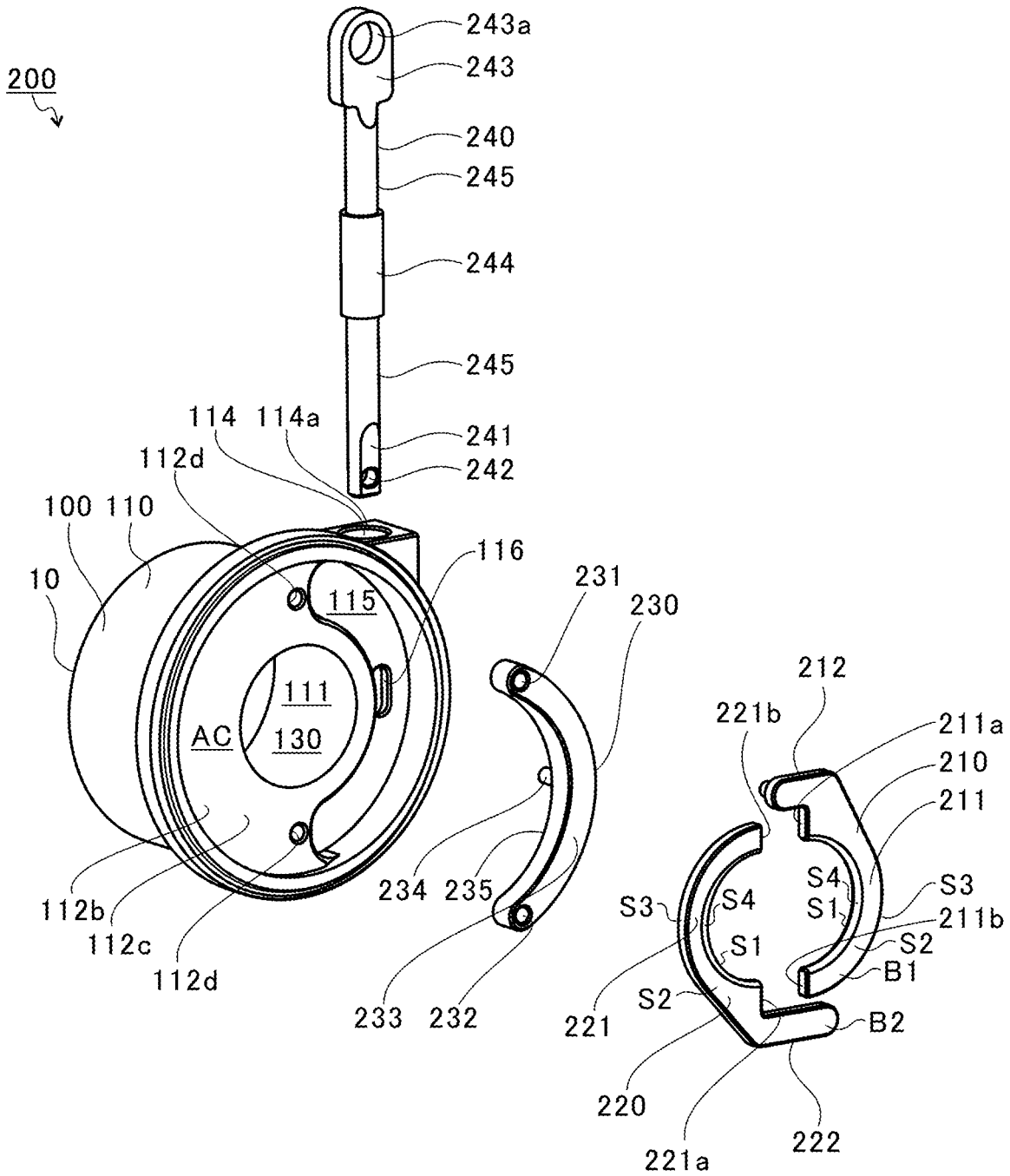
FIG. 3 is an exploded perspective view of components of a link mechanism.

FIG. 3 is an exploded perspective view of components of the link mechanism 200. In FIG. 3, the first housing portion 110 is only shown among the compressor housing 100. As shown in FIG. 3, the link mechanism 200 includes the first housing portion 110, a first movable portion 210, a second movable portion 220, a connecting portion 230, and a rod 240. In the rotational axis direction, the link mechanism 200 is arranged closer to the inlet 10 (on the upstream side) with respect to the compressor impeller 9 in the intake flow path 130.

The first movable portion 210 is arranged in the accommodation groove 112*b* (accommodation chamber AC). Specifically, in the rotational axis direction, the first movable portion 210 is arranged between the wall surface 112*c* of the accommodation groove 112*b* and the wall surface 122*b* of the accommodation groove 122*a* (see FIG. 2).

The first movable portion 210 has an intake upstream surface S1, an intake downstream surface S2, a radial outer surface S3 and a radial inner surface S4. In the first movable portion 210, the intake upstream surface S1 is a surface on the upstream side in the flow of the intake air (upstream side in the intake flow path 130). In the first movable portion 210, the intake downstream surface S2 is a surface on the downstream side in the flow of the intake air (downstream side in the intake flow path 130). In the first movable portion 210, the radial outer surface S3 is a surface on an outer side, in the radial direction of the compressor impeller 9 (see FIG. 2). In the first movable portion 210, the radial inner surface S4 is a surface on an inner side, in the radial direction of the compressor impeller 9.

The first movable portion 210 includes a body portion B1. The body portion B1 includes a curved portion 211 and an arm portion 212. The curved portion 211 extends in the circumferential direction of the compressor impeller 9. The curved portion 211 has a substantially semi-circular arcuate shape. The curved portion 211 includes circumferential first and second end faces 211*a* and 211*b* extending parallel to the radial direction and the rotational axis direction. However, the first and second end faces 211*a* and 211*b* may be inclined with respect to the radial direction and the rotational axis direction.

The arm portion 212 is provided at the first end face 211*a* of the curved portion 211. The arm portion 212 extends radially outward from the radial outer surface S3 of the curved portion 211. Furthermore, the arm portion 212 extends in a direction inclined to the radial direction (toward the second movable portion 220).

The second movable portion 220 is arranged in the accommodation groove 112*b* (accommodation chamber AC). Specifically, in the rotational axis direction, the second movable portion 220 is arranged between the wall surface 112*c* of the accommodation groove 112*b* and the wall surface 122*b* of the accommodation groove 122*a* (see FIG. 2).

The second movable portion 220 includes an intake upstream surface S1, an intake downstream surface S2, a radial outer surface S3 and a radial inner surface S4. In the second movable portion 220, the intake upstream surface S1 is a surface on the upstream side in the flow of the intake air (upstream side in the intake flow path 130). In the second movable portion 220, the intake downstream surface S2 is a surface on the downstream side in the flow of the intake air (downstream side in the intake flow path 130). In the second movable portion 220, the radial outer surface S3 is a surface on an outer side, in the radial direction of the compressor impeller 9 (FIG. 2) In the second movable portion 220, the radial inner surface S4 is a surface on an inner side, in the radial direction of the compressor impeller 9.

The second movable portion 220 includes a body portion B2. The body portion B2 includes a curved portion 221 and an arm portion 222. The curved portion 221 extends in the circumferential direction of the compressor impeller 9. The curved portion 221 has a substantially semi-circular arcuate shape. The curved portion 221 includes circumferential first and second end faces 221*a* and 221*b* extending parallel to the radial direction and the rotational axis direction. However, the first and second end faces 221*a* and 221 *b* may be inclined with respect to the radial direction and the rotational axis direction.

The arm portion 222 is provided at the first end face 221*a* of the curved portion 221. The arm portion 222 extends radially outward from the radial outer surface S3 of the curved portion 221. Furthermore, the arm portion 222 extends in a direction inclined to the radial direction (toward the first movable portion 210).

The curved portion 211 faces the curved portion 221 across a center of rotation of the compressor impeller 9 (intake flow path 130). The first end face 211*a* of the curved portion 211 circumferentially faces the second end face 221*b* of the curved portion 221. The second end face 211*b* of the curvature 211 circumferentially faces the second end face 221*b* of the curvature 221. The first movable portion 210 and the second movable portion 220 are configured such that the curved portions 211 and 221 are movable in the radial direction, as described later in detail.

The connecting portion 230 is connected to the first movable portion 210 and the second movable portion 220. The connecting portion 230 is located closer to the inlet 10 with respect to the first movable portion 210 and the second movable portion 220. The connecting portion 230 has a substantially arc shape. A first bearing hole 231 is formed at one end of the connecting portion 230 in the circumferential direction, and a second bearing hole 232 is formed at the other end. In the connecting portion 230, the first bearing hole 231 and the second bearing hole 232 are opened on an end face 233 closer to the first movable portion 210 and the second movable portion 220. The first bearing hole 231 and the second bearing hole 232 extend in the rotational axis direction. In the present embodiment, the first bearing hole 231 and the second bearing hole 232 are formed as a non-through hole. However, the first bearing hole 231 and the second bearing hole 232 may penetrate the connecting portion 230 in the rotational axis direction.

A rod connection 234 is formed between the first and second bearing holes 232 in the connecting portion 230. In the connecting portion 230, the rod connection 234 is formed on an end face 235 opposite the first movable portion 210 and the second movable portion 220. The rod connection 234 protrudes from the end face 235 in the rotational axis direction. The rod connection 234 has, for example, a substantially cylindrical shape.

A rod 240 has a substantially cylindrical shape. A flat portion 241 is formed at one end of rod 240 and a connection 243 is formed at the other end. The flat portion 241 extends in a plane direction substantially perpendicular to the rotational axis direction. The flat portion 241 includes a bearing hole 242. The bearing hole 242 extends in the rotational axis direction. The connection 243 includes a connection hole 243*a*. The connection 243 (connection hole 243*a*) is connected to an actuator (described later). For example, the bearing hole 242 may be an elongated hole of which length in a direction perpendicular to the rotational axis direction and an axis direction of the rod 240 is longer than a length in the axis direction of the rod 240.

A rod large-diameter portion 244 and two rod small-diameter portions 245 are formed between the flat portion 241 and the connecting portion 243 of the rod 240. The rod large-diameter portion 244 is arranged between the two rod small-diameter portions 245. Between the two rod small-diameter portions 245, the rod small-diameter portion 245 closer to the flat portion 241 connects the rod large-diameter portion 244 to the flat portion 241. Between the two rod small-diameter portions 245, the rod small-diameter portion 245 closer to the connection 243 connects the rod large-diameter portion 244 to the connection 243. An outer diameter of the rod large-diameter portion 244 is larger than outer diameters of the two rod small-diameter portions 245.

The first housing portion 110 includes an insertion hole 114. One end 114*a* of the insertion hole 114 is opened to the outside of the first housing portion 110. The insertion hole 114 extends, for example, in a direction perpendicular to the rotational axis direction. The insertion hole 114 is located radially outside the through hole 111 (intake flow path 130). The flat portion 241 of the rod 240 is inserted into the insertion hole 114. The rod large-diameter portion 244 is guided by an inner wall of the insertion hole 114. The rod 240 is restricted from movements other than in a central axis direction of the insertion hole 114 (central axis direction of the rod 240).

The accommodation hole 115 is formed in the first housing portion 110. The accommodation hole 115 is opened on the wall surface 112*c* of the accommodation groove 112*b*. The accommodation hole 115 is recessed from the wall surface 112*c* toward the inlet 10. The accommodation hole 115 is located on a side spaced apart from the inlet 10 (on a side closer to the second housing portion 120) with respect to the insertion hole 114. The accommodation hole 115 has a substantially arc shape when seen from the rotational axis direction. The accommodation hole 115 extends circumferentially longer than the connecting portion 230. The accommodation hole 115 is circumferentially spaced apart from the bearing hole 112*d*.

A communication hole 116 is formed in the first housing portion 110. The communication hole 116 connects the insertion hole 114 to the accommodation hole 115. The communication hole 116 is formed in a substantially circumferential middle portion of the accommodation hole 115. The communication hole 116 is, for example, an elongated hole extending substantially parallel to an extending direction of the insertion hole 114. A width in a longitudinal direction (extending direction) of the communication hole 116 is larger than a width in a lateral direction (direction perpendicular to the extending direction). The width in the lateral direction of the insertion hole 114 is larger than an outer diameter of the rod connection 234 of the connecting portion 230.

The connecting portion 230 is accommodated in the accommodation hole 115 (accommodation chamber AC). As such, the first movable portion 210, the second movable portion 220, and the connecting portion 230 are arranged in the accommodation chamber AC formed in the first housing portion 110. The accommodation hole 115 is longer in the circumferential direction and wider in the radial direction than the connecting portion 230. Therefore, the connecting portion 230 is allowed to move in the plane direction perpendicular to the rotational axis direction within the accommodation hole 115.

The rod connection 234 is inserted through the communication hole 116 into the insertion hole 114. The flat portion 241 of rod 240 is inserted into the insertion hole 114. The bearing hole 242 of the flat portion 241 faces the communication hole 116. The rod connection 234 is inserted into (connected to) the bearing hole 242. The rod connection 234 is supported by the bearing hole 242.

Figure 4:
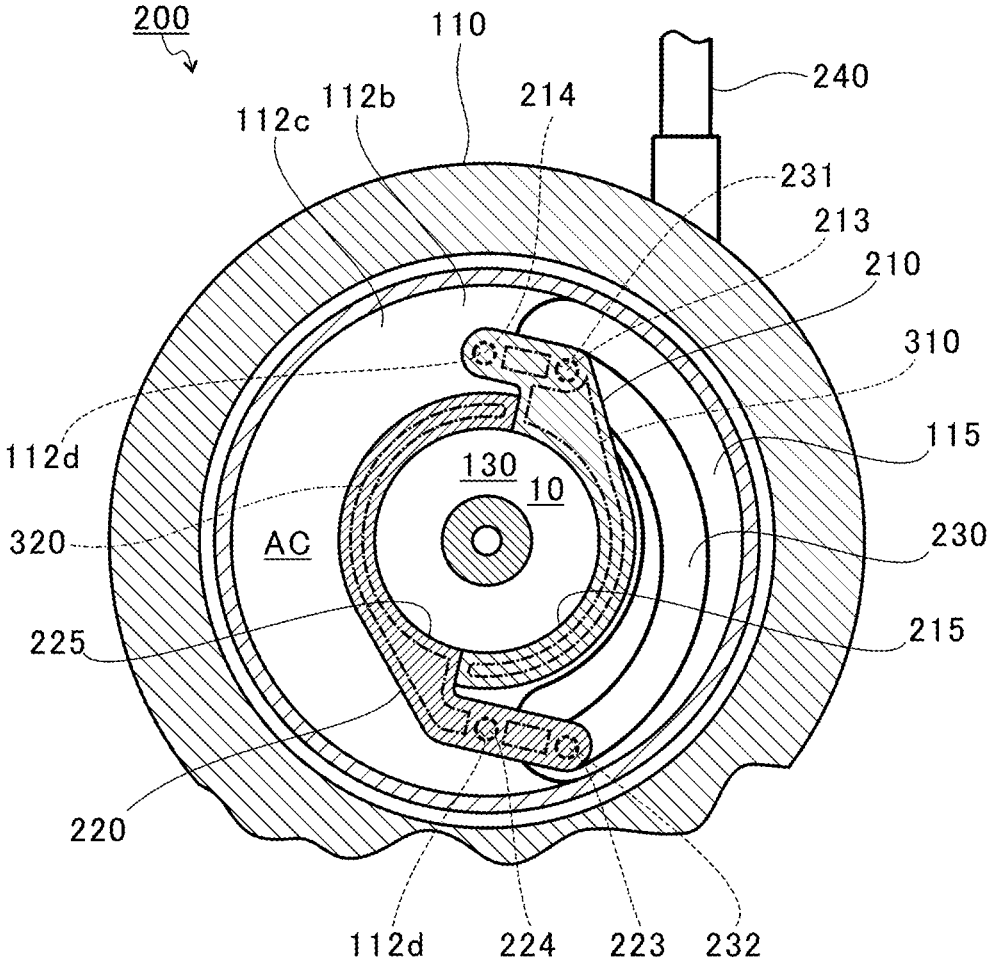
FIG. 4 is a cross-sectional view taken along IV-IV line in FIG. 2.

FIG. 4 is a cross-sectional view taken along IV-IV line in FIG. 2. As shown in dashed lines in FIG. 4, the first movable portion 210 includes a connecting shaft portion 213 and a rotational shaft portion 214. In the first movable portion 210, the connecting shaft portion 213 and the rotational shaft portion 214 protrude in the rotational axis direction from the intake upstream surface S1 (see FIG. 2) facing the wall surface 112*c*. The connecting shaft portion 213 and the rotational shaft portion 214 extend backward of the paper in FIG. 4. The rotational shaft portion 214 extends parallel to the connecting shaft portion 213. The connecting shaft portion 213 and the rotational shaft portion 214 have a substantially cylindrical shape.

An outer diameter of the connecting shaft portion 213 is smaller than an inner diameter of the first bearing hole 231 of the connecting portion 230. The connecting shaft portion 213 is inserted into the first bearing hole 231. The connecting shaft portion 213 is rotatably supported by the first bearing hole 231. An outer diameter of the rotational shaft portion 214 is smaller than an inner diameter of the bearing hole 112*d* of the first housing portion 110. Between the two bearing holes 112*d*, the rotational shaft portion 214 is inserted into the bearing hole 112*d* located on a vertically upper side (closer to the rod 240). The rotational shaft portion 214 is rotatably supported by the bearing hole 112*d*.

The second movable portion 220 includes a connecting shaft portion 223 and a rotational shaft portion 224. In the second movable portion 220, the connecting shaft portion 223 and the rotational shaft portion 224 protrude in the rotational axis direction from the intake upstream surface S1 (see FIG. 2) facing the wall surface 112*c*. The connecting shaft portion 223 and the rotational shaft portion 224 extend backward of the paper in FIG. 4. The rotational shaft portion 224 extends parallel to the connecting shaft portion 223. The connecting shaft portion 223 and the rotational shaft portion 224 have a substantially cylindrical shape.

An outer diameter of the connecting shaft portion 223 is smaller than an inner diameter of the second bearing hole 232 of the connecting portion 230. The connecting shaft portion 223 is inserted into the second bearing hole 232. The connecting shaft portion 223 is rotatably supported by the second bearing hole 232. An outer diameter of the rotational shaft portion 224 is smaller than an inner diameter of the bearing hole 112*d*. Between the two bearing holes 112*d*, the rotational shaft portion 224 is inserted into the bearing hole 112*d* located on a vertically lower side (spaced apart from the rod 240). The rotational shaft portion 224 is rotatably supported by the bearing hole 112*d*.

Accordingly, the link mechanism 200 includes a four-bar linkage. The four links (nodes) are the first movable portion 210, the second movable portion 220, the first housing portion 110, and the connecting portion 230. Since the link mechanism 200 includes the four-bar linkage, it is a limited chain and has one degree of freedom, making it easy to control.

Figure 5:
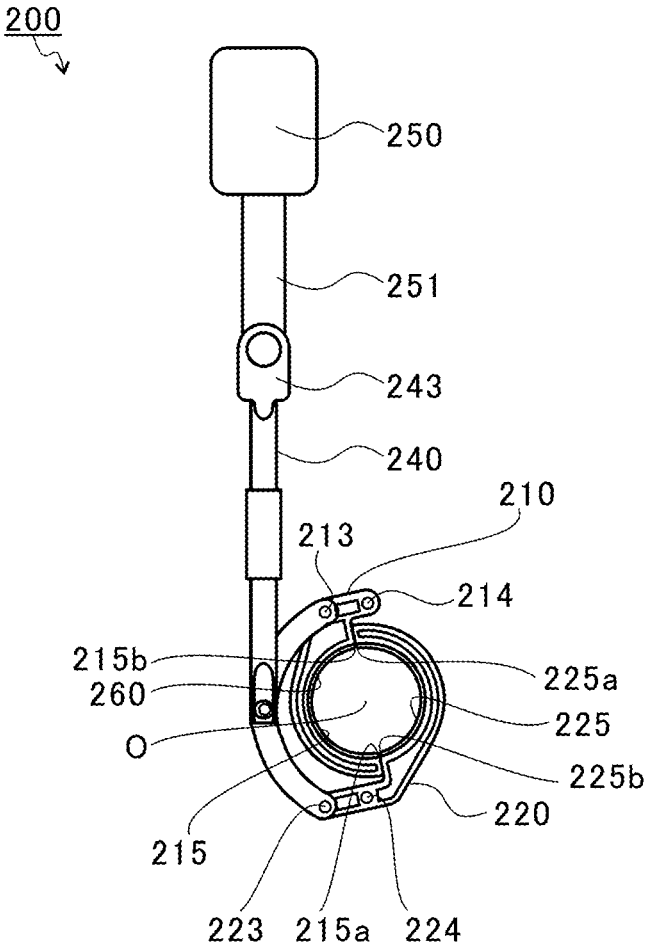
FIG. 5 is a first illustration of an operation of the link mechanism.

FIG. 5 is a first illustration of an operation of the link mechanism 200. In the following FIGS. 5, 6, and 7, the link mechanism 200 is seen from the inlet 10. As shown in FIG. 5, an end of a drive shaft 251 of an actuator 250 is connected to the connection 243 of the rod 240.

In the arrangement shown in FIG. 5, the first movable portion 210 and the second movable portion 220 are in contact with each other. As shown in FIGS. 2 and 4, the protrusion 215 that is a radially inner part of the first movable portion 210 protrudes (is exposed) into the intake flow path 130. The protrusion 225 that is a radially inner part of the second movable portion 220 protrudes (is exposed) into the intake flow path 130. The positions of the first movable portion 210 and the second movable portion 220 at this state are referred to as a protruding position (or a throttling position).

As shown in FIG. 5, in the protruding position, circumferential ends 215*a*, 215*b* of the protrusion 215 are in contact with circumferential ends 225*a*, 225*b* of the protrusion 225, respectively. The protrusion 215 and the protrusion 225 form an annular hole 260. An inner diameter of the annular hole 260 is smaller than an inner diameter of the intake flow path 130 at a position where the protrusions 215 and 225 protrude. For example, the inner diameter of the annular hole 260 is smaller than the inner diameter of the intake flow path 130 at any locations.

Figure 6:
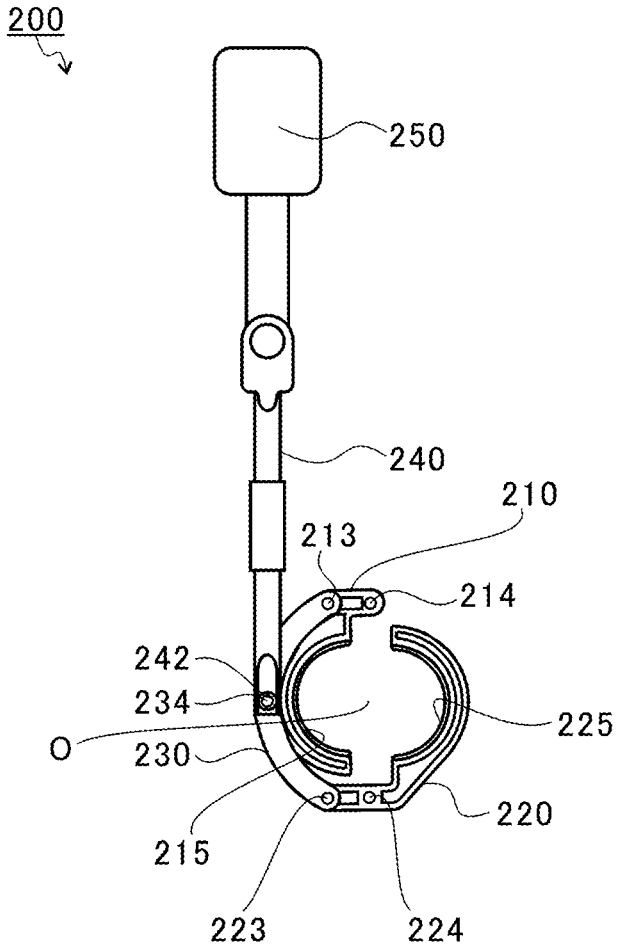
FIG. 6 is a second illustration of the operation of the link mechanism.
Figure 7:
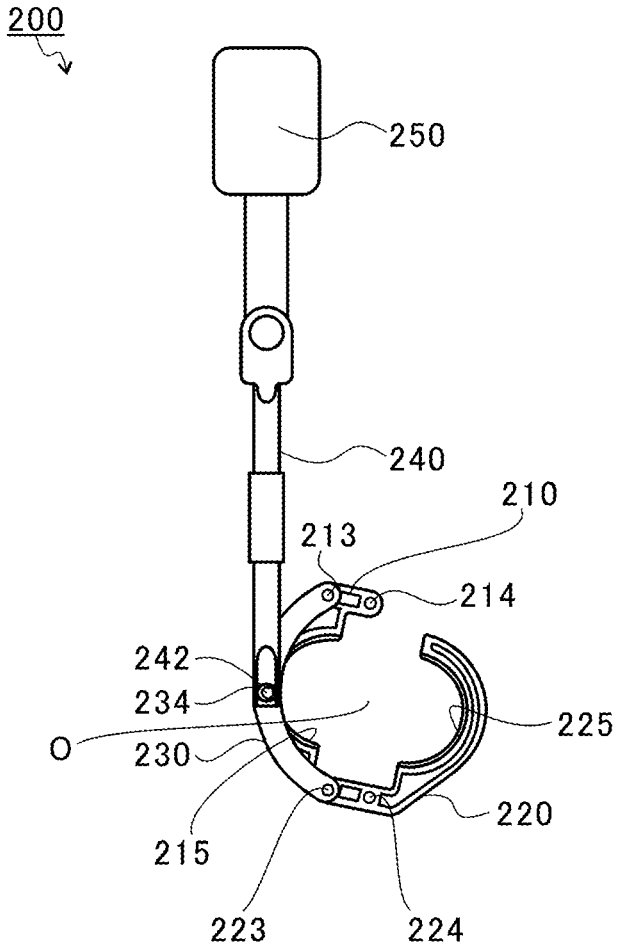
FIG. 7 is a third illustration of the operation of the link mechanism.

FIG. 6 is second illustration of the operation of the link mechanism 200. FIG. 7 is a third illustration of the operation of the link mechanism 200. The actuator 250 linearly moves the rod 240 in a direction intersecting the rotational axis direction (up-and-down direction in FIGS. 6 and 7). In FIGS. 6 and 7, the rod 240 moves upward from the position shown in FIG. 5. The amount of movement of the rod 240 with respect to the position shown in FIG. 5 is larger in the position shown in FIG. 7 than in the position shown in FIG. 6.

As the rod 240 moves, the connecting portion 230 moves upward in FIGS. 6 and 7 via the rod connection 234. At this state, the connecting portion 230 is allowed to rotate around the rod connection 234. Furthermore, the inner diameter of the bearing hole 242 has a slight play with respect to the outer diameter of the rod connection 234. Therefore, the connecting portion 230 is allowed to slightly move in the plane direction perpendicular to the rotational axis direction.

As mentioned above, the link mechanism 200 includes the four-bar linkage. The connecting portion 230, first movable portion 210 and second movable portion 220 exhibit a one-degree-of-freedom behavior with respect to the first housing portion 110. Specifically, the connecting portion 230 slightly rotates counterclockwise, while slightly moving in the left-to-right direction in FIGS. 6 and 7, within the above-described allowable range.

In the first movable portion 210, the rotational shaft portion 214 is supported by the first housing portion 110. The rotational shaft portion 214 is restricted from the movement in the plane direction perpendicular to the rotational axis direction. The connecting shaft portion 213 is supported by the connecting portion 230. Since the movement of the connecting portion 230 is allowed, the connecting shaft portion 213 is movable in the plane direction perpendicular to the rotational axis direction. As a result, the first movable portion 210 rotates in a clockwise direction in FIGS. 6 and 7 around the rotational shaft portion 214, as the connecting portion 230 moves.

Similarly, in the second movable portion 220, the rotational shaft portion 224 is supported by the first housing portion 110. The rotational shaft portion 224 is restricted from the movement in the plane direction perpendicular to the rotational axis direction. The connecting shaft portion 223 is supported by the connecting portion 230. Since the movement of the connecting portion 230 is allowed, the connecting shaft portion 223 is movable in the plane direction perpendicular to the rotational axis direction. As a result, the second movable portion 220 rotates in a clockwise direction in FIGS. 6 and 7 around the rotational shaft portion 224, as the connecting portion 230 moves.

As such, the first movable portion 210 and the second movable portion 220 move in directions spaced apart from each other in the order of FIG. 6 and FIG. 7. The protrusions 215, 225 move to a position (retracted position) radially outside the protruding position. In the retracted position, for example, the protrusions 215, 225 are flush with the inner wall surface of the intake flow path 130, or positioned radially outside the inner wall surface of the intake flow path 130. When moving from the retracted position to the protruding position, the first movable portion 210 and the second movable portion 220 approach and contact with each other, in the order of FIG. 7, FIG. 6, and FIG. 5. As such, the first movable portion 210 and the second movable portion 220 are switched between the protruding position and the retracted position according to the rotational angle around the rotational shaft portions 214, 224.

Accordingly, the first movable portion 210 and the second movable portion 220 are configured to be movable between the protruding position where the first movable portion 210 and the second movable portion 220 protrude into the intake flow path 130, and the retracted position where the first movable portion 210 and the second movable portion 220 are not exposed (do not protrude) into the intake flow path 130. In this embodiment, the first movable portion 210 and the second movable portion 220 move in the radial direction of the compressor impeller 9. However, the first movable portion 210 and second movable portion 220 are not limited thereto, and may rotate around the rotational axis of the compressor impeller 9 (in the circumferential direction). For example, the first movable portion 210 and the second movable portion 220 may be shutter blades including two or more blades.

When the first movable portion 210 and the second movable portion 220 are in the retracted position and do not protrude into the intake flow path 130 (hereinafter, also referred to as a retracted position state), a pressure loss of the intake air flowing in the intake flow path 130 can be reduced.

As shown in FIG. 2, in the protruding position, the protrusions 215, 225 of the first movable portion 210 and the second movable portion 220 are arranged in the intake flow path 130. When the first movable portion 210 and the second movable portion 220 are in the protruding position, the cross-sectional area of the intake flow path 130 decreases.

As the flow rate of the air flowing into the compressor impeller 9 decreases, the air compressed by the compressor impeller 9 may flow backward in the intake flow path 130 (i.e., the air flows from the downstream side to the upstream side).

As shown in FIG. 2, when the first movable portion 210 and the second movable portion 220 are located in the protruding position (hereinafter, also referred to as a protruding position state), the protrusions 215, 225 are located radially inside the outermost end of the leading edge LE of the compressor impeller 9. As a result, the air flowing backward in the intake flow path 130 are blocked by the protrusions 215, 225. Accordingly, the first movable portion 210 and the second movable portion 220 can curb the air flowing backward in the intake flow path 130.

Furthermore, since the cross-sectional area of the intake flow path 130 is reduced, the flow velocity of the air flowing into the compressor impeller 9 is increased. As a result, surging in the centrifugal compressor CC can be curbed. In other words, the centrifugal compressor CC of the present embodiment can expand the operational range of the centrifugal compressor CC to the smaller flow rate area by forming the protruding position state.

As such, the first movable portion 210 and the second movable portion 220 are configured as throttling portions that throttles the intake flow path 130. In other words, in the present embodiment, the link mechanism 200 is configured as a throttling mechanism that throttles the intake flow path 130. The first movable portion 210 and the second movable portion 220 can change the cross-sectional area of the intake flow path 130 by operating the link mechanism 200.

The first movable portion 210 and the second movable portion 220 may be made from a resin material, in order to reduce the weight of the link mechanism 200. For example, the first movable portion 210 and the second movable portion 220 may be formed by injection molding. When the first movable portion 210 and the second movable portion 220 are formed by injection molding, the first movable portion 210 and the second movable portion 220 may include a sink mark (dimple) or a curve. If the first movable portion 210 and the second movable portion 220 include a sink mark or a curve, the first movable portion 210 and the second movable portion 220 may interfere with other components or wall surfaces, thereby leading to malfunction.

Accordingly, the link mechanism 200 of the present embodiment includes grooves 310 in the first movable portion 210, as indicated by dashed-dotted lines in FIG. 4. The link mechanism 200 also includes grooves 320 in the second movable portion 220. In the present embodiment, the first movable portion 210 and the second movable portion 220 are made from a resin material. The grooves 310, 320 are formed when the first movable portion 210 and the second movable portion 220 are made by injection molding.

Figure 8:
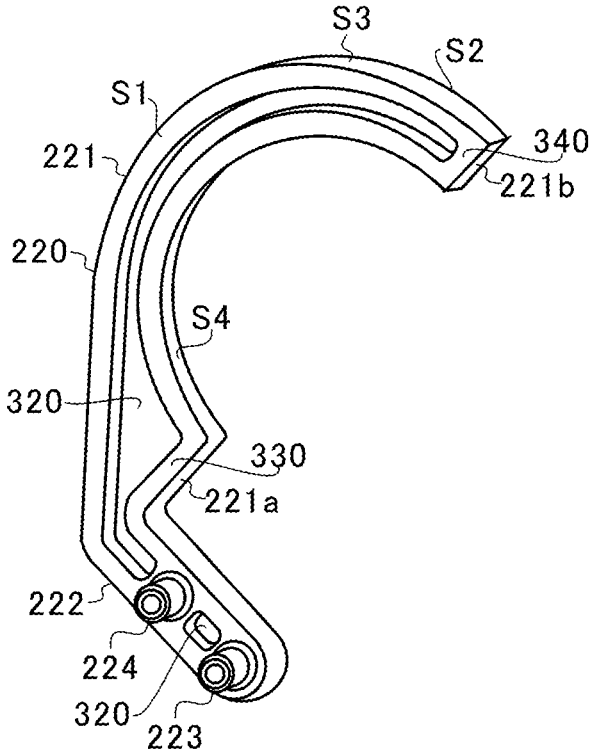
FIG. 8 is a schematic perspective view of a second movable portion according to an embodiment.

FIG. 8 is a schematic perspective view of the second movable portion 220 according to the present embodiment. As shown in FIG. 8, the grooves 320 are formed in the second movable portion 220. The groove 320 is formed over the curved portion 221 and the arm portion 222. The groove 320 is also formed between the connecting shaft portion 223 and the rotational shaft portion 224. In the present embodiment, the grooves 320 of the second movable portion 220 are explained. In the present embodiment, the grooves 310 of the first movable portion 210 are configured the same as the grooves 320 of the second movable portion 220. Accordingly, the grooves 320 of the second movable portion 220 are explained in detail below, and explanations of the grooves 310 of the first movable portion 210 are omitted.

The grooves 320 are formed on the intake upstream surface S1. A first thick-walled portion 330 is formed between the groove 320 and the first end face 221*a* of the curved portion 221. A second thick-walled portion 340 is formed between the groove 320 and the second end face 221*b* of the curved portion 221. In the circumferential direction of the compressor impeller 9, a thickness (width) of the first thick-walled portion 330 is equal to a thickness (width) of the second thick-walled portion 340.

In this context, the term "equal" means being completely equal, and also deviating from completely equal within tolerances (machining accuracy, assembly error, etc.). Hereinafter, the term "equal" or "the same" means being completely equal (the same), and also deviating from completely equal (the same) within tolerances (machining accuracy, assembly error, etc.).

Figure 9:
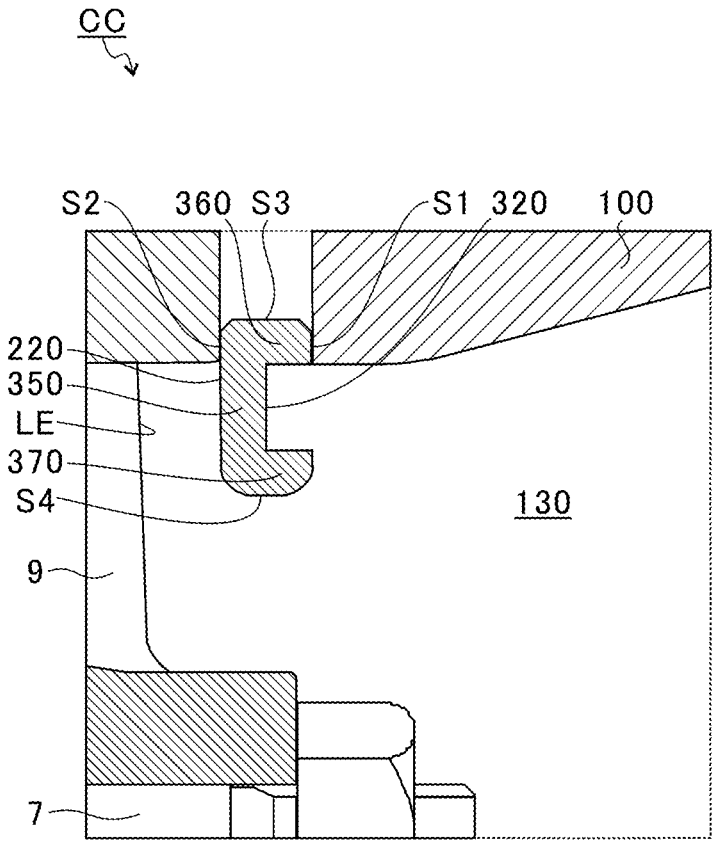
FIG. 9 is a schematic cross-sectional view of a curved portion of the second movable portion in a protruding position state.

FIG. 9 is a schematic cross-sectional view of the curved portion 221 of the second movable portion 220 in the protruding position state. As shown in FIG. 9, a third thick-walled portion 350 is formed between the groove 320 and the intake downstream surface S2. A fourth thick-walled portion 360 is formed between the groove 320 and the radial outer surface S3. A fifth thick-walled portion 370 is formed between the groove 320 and the radial inner surface S4.

A thickness (width) in the rotational axis direction of the third thick-walled portion 350, a thickness (width) in the radial direction of the fourth thick-walled portion 360, and a thickness (width) in the radial direction of the fifth thick-walled portion 370 are equal to each other. Furthermore, thicknesses in the circumferential direction of the first thick-walled portion 330 and the second thick-walled portion 340 are equal to the thickness in the rotational axis direction of the third thick-walled portion 350 and the thickness in the radial direction of the fourth thick-walled portion 360 and the fifth thick-walled portion 370. In other words, the thicknesses of the second movable portion 220 in the rotational axis direction, the radial direction, and the circumferential direction of the compressor impeller 9 are equal to each other. That is, the second movable portion 220 has the constant thicknesses in the rotational axis direction, the radial direction, and the circumferential direction of the compressor impeller 9.

As such, the maximum thickness during injection molding can be reduced by providing the groove 320 in the second movable portion 220, compared to the case where the second movable portion 220 is solid. Accordingly, a sink mark or a curve can be reduced during injection molding. As a result, malfunction can be prevented even when the second movable portion 220 is made from a resin material by injection molding.

Furthermore, the groove 320 is formed in the second movable portion 220 (protrusion 225) in an area other than the intake downstream surface S2. If the groove 320 is formed on the intake downstream surface S2 of the protrusion 225, the air flowing backward in the intake flow path 130 during surging flows into the groove 320 on the intake downstream surface S2. If the air flowing backward flows into the groove 320, a pressure loss would be increased, compared to the case in which the air flows onto the intake downstream surface S2 of the protrusion 225 without the groove 320. The increase of the pressure loss results in a lower compressor efficiency.

Accordingly, in the present embodiment, the groove 320 is formed on the intake upstream surface S1 of the second movable portion 220 (protrusion 225). In the protruding position state, a pooling area where the air is accumulated without flowing through is formed around the intake upstream surface S1 of the protrusion 225. The pressure loss increases as a speed of air increases. During surging, the speed of air is higher in the area around the intake downstream surface S2 (where the air flowing backward flows onto) than in the area around the intake upstream surface S1 (where the pooling area is formed) of the protrusion 225. Accordingly, the pressure loss can be reduced by forming the groove 320 on the intake upstream surface S1, rather than forming the groove 320 on the intake downstream surface S2. As a result, a decrease in compressor efficiency can be curbed. In addition, in the protruding position state, the air flowing backward in the intake airflow path 130 pushes the first movable portion 210 and the second movable portion 220 against the wall surface 112*c* (compressor housing 100) toward the upstream side in the flow of the intake air. At this state, a frictional force between the wall surface 112*c* and the first movable portion 210 and the second movable portion 220 increases. In this case, the first movable portion 210 and the second movable portion 220 are less likely to move radially outward. In this embodiment, the contact area between the intake upstream surface S1 (the second movable portion 220) and the wall surface 112*c* can be reduced by forming the groove 320 on the intake upstream surface S1. Accordingly, the frictional force between the second movable portion 220 and the wall surface 112*c* can be reduced.

Furthermore, molding (injection molding) is easier when the groove 320 is formed so as to be recessed in a thickness direction (rotational axis direction) of the second movable portion 220, compared to the case where the groove is formed so as to be recessed in the radial direction of the curved portion 221. Accordingly, forming the groove 320 on the intake upstream surface S1 of the second movable portion 220 makes the molding easier, compared to forming the groove 320 on the radial outer surface S3 or on the radial inner surface S4.

The groove 320 extends in the circumferential direction of the compressor impeller 9, and extends circumferentially over the curved portion 221 and the arm portion 222. This allows the thickness in the rotational axis direction of the third thick-walled portion 350 and the thicknesses in the radial direction of the fourth thick-walled portion 360 and the fifth thick-walled portion 370 be constant over the circumferential direction.

(Variant)

Figure 10:
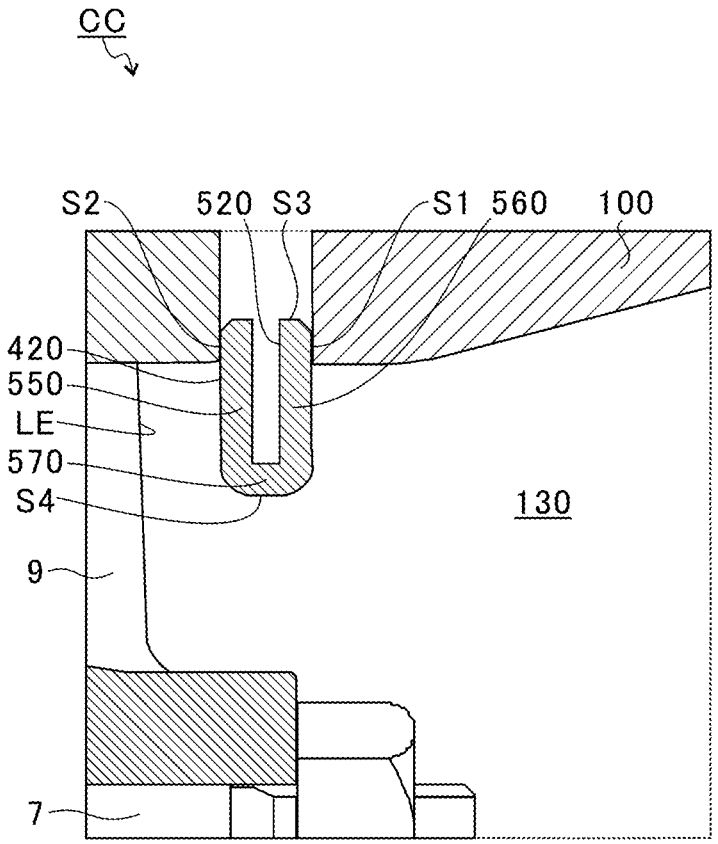
FIG. 10 is a schematic perspective view of a second movable portion according to a variant.

FIG. 10 is a schematic perspective view of a second movable portion 420 according to a variant. The components substantially equivalent to those of the centrifugal compressor CC of the above-described embodiment will be assigned with the same reference signs and the descriptions thereof will be omitted. The second movable portion 420 of this variant is different form the above-described embodiment in that a groove 520 is not formed on the intake upstream surface S1, but formed on the radial outer surface S3.

FIG. 10 shows a schematical cross-sectional view of the curved portion 221 of the second movable portion 420 in the protruding position state. As shown in FIG. 10, the groove 520 is formed in the second movable portion 420. The groove 520 is formed on the radial outer surface S3. A third thick-walled portion 550 is formed between the groove 520 and the intake downstream surface S2. A fourth thick-walled portion 560 is formed between the groove 320 and the intake upstream surface S1. A fifth thick-walled portion 570 is formed between the groove 520 and radial inner surface S4. The thickness (width) in the rotational axis direction of the third thick-walled portion 550, the thickness (width) in the rotational axis direction of the fourth thick-walled portion 560, and the thickness (width) in the radial direction of the fifth thick-walled portion 570 are equal to each other.

Furthermore, the groove 520 extends in the circumferential direction of the compressor impeller 9. The first thick-walled portion 330 is formed between the groove 520 and the first end face 221*a* of the curved portion 221 (see FIG. 8). The second thick-walled portion 340 is formed between the groove 520 and the second end face 221*b* of the curved portion 221 (see FIG. 8). In the circumferential direction of the compressor impeller 9, the thickness (width) of the first thick-walled portion 330 and the thickness (width) of the second thick-walled portion 340 are equal to each other. The thicknesses in the circumferential direction of the first thick-walled portion 330 and the second thick-walled portion 340 are equal to the thicknesses in the rotational axis direction of the third thick-walled portion 550 and the fourth thick-walled portion 560 and the thickness in the radial thickness of the fifth thick-walled portion 570. In other words, the thicknesses of the second movable portion 420 in the rotational axis direction, the radial direction and the circumferential direction of the compressor impeller 9 are equal to each other. That is, the second movable portion 420 has the constant thicknesses in the rotational axis direction, the radial direction and the circumferential direction of the compressor impeller 9.

According to this variant, the groove 520 is formed in an area other than the intake downstream surface S2 in the second movable portion 420 (protrusion 225). Therefore, the same functions and effects as those in the above-described embodiment can be achieved.

Furthermore, in this variant, the groove 520 is formed on the radial outer surface S3 of the second movable portion 420. As such, the groove 520 is not exposed on the protrusion 225 of the second movable portion 420, making it more difficult for the air to flow into the groove 520, compared to the above-described embodiment. As a result, the pressure loss can be reduced and the decrease in compressor efficiency can be curbed, compared to the above-described embodiment.

Although the embodiments of the present disclosure have been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

In the above-described embodiment and variant, the first movable portion 210 and the second movable portion 220, 420 are made from a resin material by injection molding. However, the first movable portion 210 and the second movable portion 220, 420 are not limited thereto, and may be made from, for example, a metal by casting.

In the above-described embodiment and variant, the groove 320, 520 is located on the intake upstream surface S1 or on the radial outer surface S3. However, the groove 320, 520 is not limited thereto, and may be formed on the radial inner surface S4.

In the above-described embodiment and variant, the groove 320, 520 extends in the circumferential direction. However, the present disclosure is not limited thereto, and a plurality of grooves 320, 520 may be formed along the circumferential direction with being spaced apart from each other.

Furthermore, in the above-described embodiment, one of the first movable portion 210 and the second movable portion 220 may include the groove 320, and the other of the first movable portion 210 and the second movable portion 220 may include the groove 520.

What is claimed is:

1. A centrifugal compressor comprising:

a housing including an intake flow path;

a compressor impeller arranged in the intake flow path;

a movable portion arranged upstream of the compressor impeller in a flow of an intake air; and a groove formed in an area other than a surface located on a downstream side in the flow of the intake air in the movable portion, wherein the movable portion includes a pair of parallel surfaces that face each other in an axial direction or in a radial direction of the compressor impeller and define the groove.

2. The centrifugal compressor according to claim 1, wherein the groove is formed on a surface located on an upstream side in the flow of the intake air in the movable portion.

3. The centrifugal compressor according to claim 1, wherein the groove is formed on a radial outer surface in the movable portion.

4. The centrifugal compressor according to claim 1, wherein the groove extends in a circumferential direction of the compressor impeller.

5. The centrifugal compressor according to claim 2, wherein the groove extends in a circumferential direction of the compressor impeller.

6. The centrifugal compressor according to claim 3, wherein the groove extends in a circumferential direction of the compressor impeller.

7. The centrifugal compressor according to claim 1, wherein the movable portion is arranged in an accommodation groove provided in housing.

* * * * *